US005156650A

United States Patent [19]

Bals

[11] Patent Number: 5,156,650

[45] Date of Patent: Oct. 20, 1992

[54] EXERCISE DEVICE

[76] Inventor: Hans G. Bals, Blumgesgrund 44, 6460 Gelnhausen, Fed. Rep. of Germany

[21] Appl. No.: 667,311

[22] Filed: Feb. 4, 1991

[30] Foreign Application Priority Data

Apr. 3, 1989 [DE] Fed. Rep. of Germany ..... 3910704

[51] Int. Cl.[5] ..... A63B 69/16; A63B 21/068

[52] U.S. Cl. ..... 482/57; 482/95

[58] Field of Search ..... 272/72, 73, 120, 126, 272/128; 482/57, 95, 72, 96

[56] References Cited

U.S. PATENT DOCUMENTS

| | | | |
|---|---|---|---|
| 1,377,886 | 5/1921 | Hornig . | |
| 2,642,288 | 6/1953 | Bell | 272/120 |
| 4,300,760 | 11/1981 | Bobroff | 272/120 |
| 4,371,185 | 2/1983 | Bals . | |
| 4,561,648 | 12/1985 | Wu | 272/73 |
| 4,915,376 | 4/1990 | St. Clair | 272/73 |

FOREIGN PATENT DOCUMENTS

| | | | |
|---|---|---|---|
| 0000553 | 1/1983 | European Pat. Off. . | |
| 662428 | 7/1938 | Fed. Rep. of Germany . | |
| 2932041 | 2/1981 | Fed. Rep. of Germany . | |
| 3113242 | 10/1982 | Fed. Rep. of Germany | 272/73 |
| 57280 | 7/1991 | Fed. Rep. of Germany . | |
| 690722 | 9/1930 | France . | |
| 43745 | 8/1934 | France . | |
| 126301 | 1/1973 | Norway . | |
| 248369 | 2/1948 | Switzerland . | |

*Primary Examiner*—Stephen R. Crow
*Attorney, Agent, or Firm*—Larson and Taylor

[57] ABSTRACT

The present invention provides a therapeutic and sports device with a frame including four pivotably interconnected parts comprising: lower, upper, front and rear frame parts, the lower frame part being mounted between the front frame part and the rear frame part by first and second joint respectively; a stand to which supports the lower and front frame parts at a rotation bearing and third joint respectively; a saddle carried on the upper frame part; pedals attached to the lower frame part; a drive wheel for driving a flywheel, the drive wheel being pivotably mounted to the lower frame part; a crankshaft which is immovably connected to the drive wheel at a crankshaft bearing; and a connecting rod connected to the crankshaft at a crankshaft connecting rod bearing and connected to the stand at a stationary connecting rod bearing, the distance between the crankshaft bearing and a line connecting the rotation bearing and the third joint and the distance between the stationary bearing and the rotation bearing being substantially equal to the distance between the crankshaft bearing the line connecting the rotation bearing and the third joint.

4 Claims, 2 Drawing Sheets

EXERCISE DEVICE

This application is a continuation of International Application No. PCT/DE90/00246, having an international filing date of Mar. 27, 1990 and designating the United States, which application is now abandoned.

BACKGROUND OF THE INVENTION

The invention relates to an exercise device having a frame consisting of four pivotably interconnected parts. The lower frame part is mounted via a joint between its front and rear end, and the front frame part is pivotably connected to a stand. The upper frame part carries a saddle and the front frame part carries bundles. Pedals are attached to the lower frame, and the movement of one frame part in relation to another frame part or the stand is transferrable via a connecting rod and a crank to a drive wheel pivotably connected to the frame, thus driving a fly-wheel by way of transmission.

Such a device has been described in applicant's U.S. Pat. No. 4,371,185 and also in Applicant's German Patent Application No. P 31 13 242.

All devices of this kind known up to now have the disadvantage of forming different rotating angles of the drive wheel during the two phases of the reciprocal up and down movement of the frame. Because the frame consists of four joints, the different rotating angles of the drive wheel lead to different, physiologically disadvantageous accelerations of saddle, handles and pedals.

The different rotating angles of the drive wheel which occur during the two phases of movement result from the fact that the rotating movement of the lower frame part leads to a relative movement of the crankshaft bearing in relation to the stationary connecting rod bearing.

Another disadvantage of current devices of this kind is the fact that there is no possibility of integrating all rotating and swinging parts of the gear, especially connecting rod and cranks, into the gear casing in order to protect the user of the device against injuries.

SUMMARY OF THE INVENTION

The overall objective of the present invention is to provide a therapeutic and sports device which provides better harmony of movements during the two phases of the cycle and improved protection of the user against injury.

The objective of the invention is accomplished a lower frame part consisting of two parallel adjusted support struts having a crankshaft immovably connected to a drive wheel and pivotably mounted between the struts: a connecting rod is mounted to a (crankshaft throw) and is attached to a stand or fixed close to the point of equal angles between the two extreme positions of the lower frame part and the two dead centre positions of the connecting rod.

The above arrangement occurs when the distance between a crankshaft bearing and a line connecting the rotation axis of the lower frame part and the joint axis between lower and front frame part is approximately equal to, or equals the distance between a stationary connecting rod bearing axis attached to the stand and the rotation axis of the lower frame part and is equal to the distance between the connecting rod bearing axis attached to the stand and the line connecting the rotation axis and joint axis between lower and front frame part.

Thus, the phases of movement of the crankshaft with the drive wheel as well as the speeds and accelerations of saddle, handles and pedals in relation to the movement of the individual elements in both phases of movement—except for the reverse movement—become equal or are substantially equal to such an extent as to guarantee harmonic movements.

Given a common casing, this arrangement also allows the protection of all rotating parts and the connecting rod against outside contact.

Additionally, it allows the lower frame part, which turns into a two-armed lever because of the rotation joint, to support the crankshaft in front of or behind the rotation joint, according to constructive estimation. Accordingly, only the arrangement of the remaining gear elements needs to be changed.

BRIEF DESCRIPTION OF THE DRAWINGS

There follows a detailed description of preferred embodiments of the present invention to be taken together with the accompanying drawings wherein.

DETAILED DESCRIPTION OF THE PREFERRED EMBODIMENTS

Figure 1:
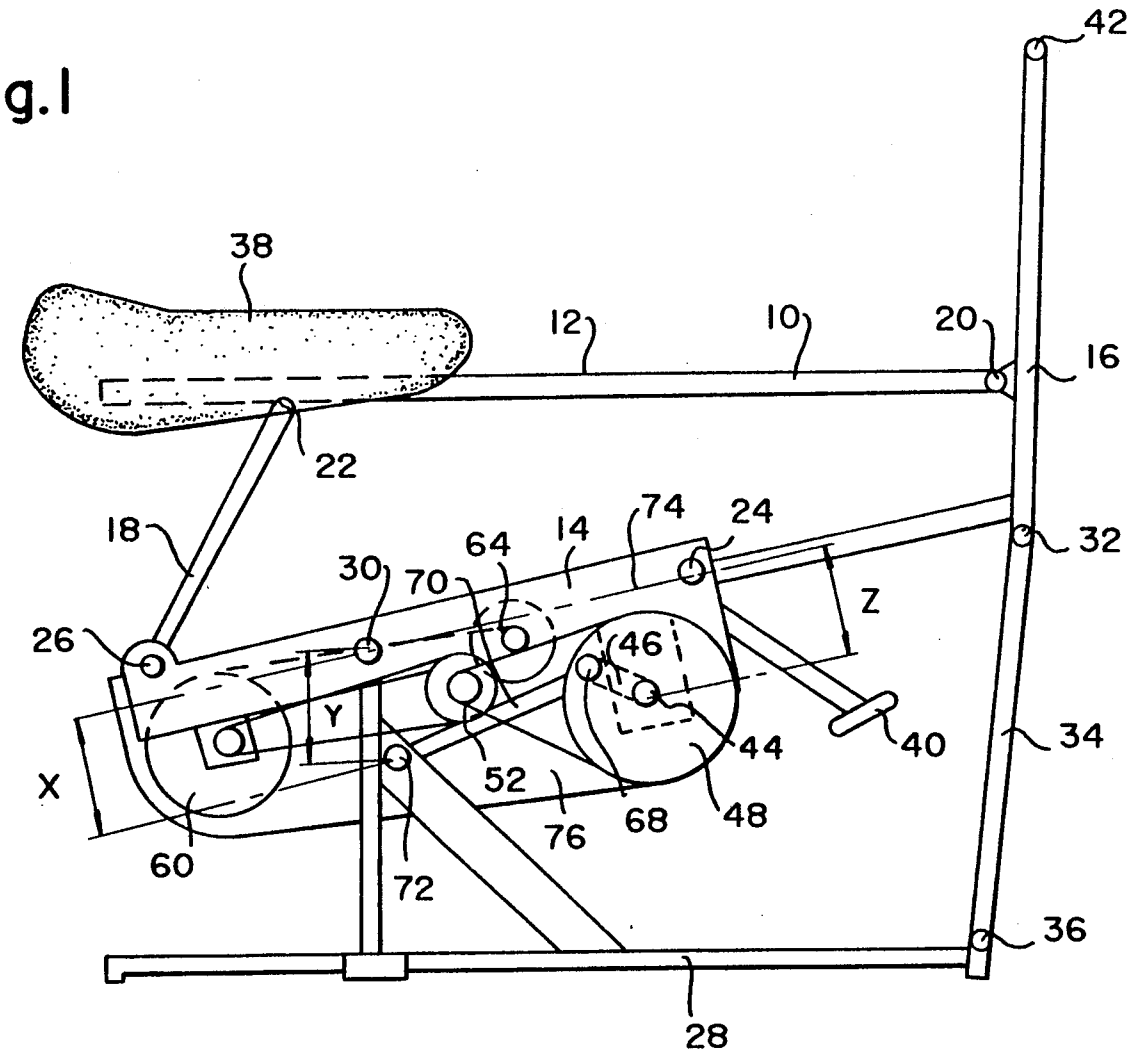
FIG. 1 is a simplified schematic side elevational view of one embodiment of an exercising device made in accordance with the present invention, with certain parts removed for purposes of clarity.

Referring now to the drawings, like elements are represented by like numerals throughout the several views. In FIG. 1, the frame 10 consists of an upper frame part 12, a lower frame part 14, a front frame part 16 and a rear frame part 18. The upper frame part 12 is connected to the front frame part 16 by means of a joint 20, and connected to the rear frame part 18 by means of a joint 22. The lower frame part 14 which is made of two support struts 74 (only one of which is visible in FIG. 1) is connected with the front frame part 16 by means of a joint 24 and with the rear frame part 18 by means of a joint 26. The entire frame 10 is carried by stand 28, whereas the lower frame part 14 is supported on stand 28 by means of a rotation bearing 30, whereas the front frame part 16 is supported on the stand by a joint 32, connecting it with rod 34 and another joint 36 on the lower part of rod 34. The upper frame part carries the saddle 38. Pedals 40 are attached to the lower frame part 14, whereas the front frame part 16 carries handles 42.

The lower frame part 14 carries the gear, consisting of the crankshaft 46 which is immovably connected to drive wheel 48, the crankshaft bearing 44, the connecting rod bearing 68, the transmission 52 as, the flywheel 60 the generator 64 and the connecting rod 70 with the stationary connecting rod bearing 72. Although the lower frame part is shown as carrying the crankshaft 46 in front of the rotation bearing 30, the gear can be arranged so that the crankshaft is carried behind rotation bearing 30. Drive wheel 48 is pivotably mounted between support struts 74 of lower part 14. A casing 76 protects all turnable parts of the gear as well as the connecting rod 70 against outside contact.

In order to provide harmony in movement among the parts of the device, the distance between X the stationary connecting rod bearing 72 and the line connecting rotation bearing 30 and joint axis 24 and the distance Y between rotation axis 30 and the stationary connecting rod bearing 72 are both approximately as large as the distance Z between crankshaft bearing 44 and the line connecting line rotation bearing 30 and joint axis 24.

Figure 2:
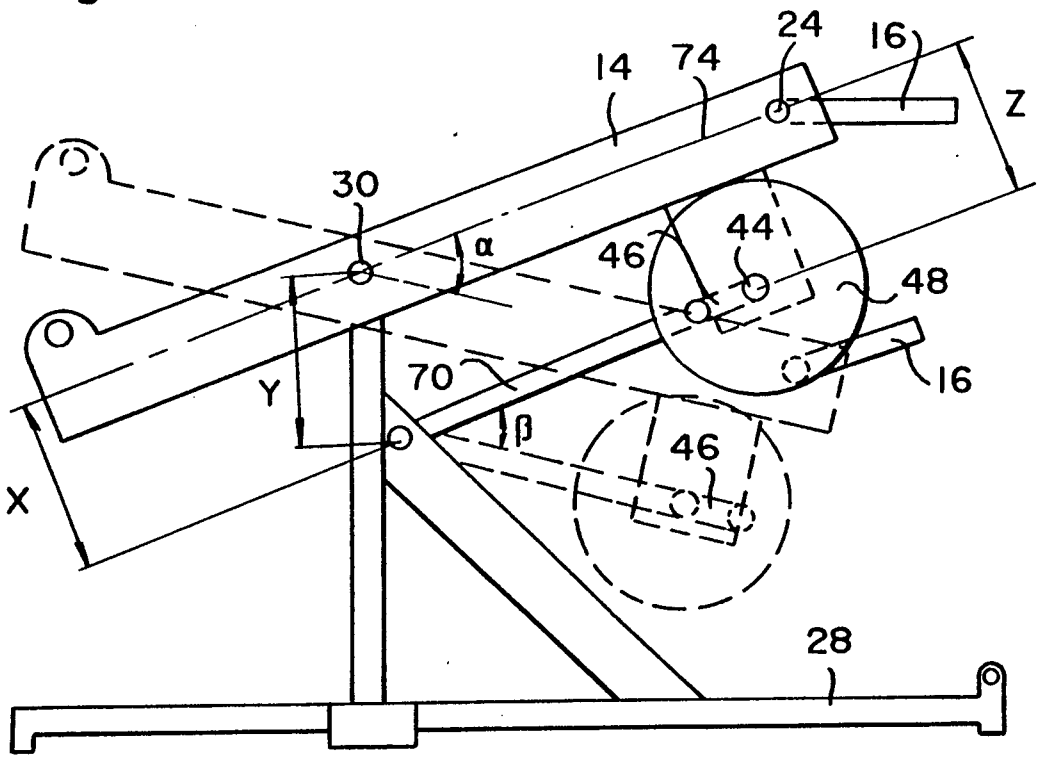
FIG. 2 is a simplified schematic side elevational view of only a portion of the exercising device, showing the parts in the two extreme end positions thereof.

FIG. 2 illustrates the lower portion and its connection to the stand, with the lower portion shown in solid lines in one of its end positions and in dotted lines in its other end position. The angle $\alpha$ between the two end positions of line 14 is approximately 35°.

The distance X between the stationary connecting rod bearing 72 and the straight line leading through the axes of rotation bearing 30 and joint 24, is approximately as long as the vertical distance Y between horizontal lines drawn through the axes of rotation bearing 30 and connecting rod bearing 72, and approximately as long as the distance Z between the axis of the crankshaft bearing 44 and the straight line leading through the axes of rotation bearing 30 and joint 24.

The two dead centre positions of connecting rod 70 now form an angle $\beta$ which, according to the invention which is 35.8° is almost identical with angle $\alpha$.

Minor differences in angle size of angles $\alpha$ and $\beta$ up to a difference of approximately 10° results in slight disadvantages regarding harmony of movement of saddle, handles and pedals and can be tolerated if they are compensated for by major constructive and other advantages.

I claim:

1. An exercise device of the type moveable through cyclic movements for the purpose of exercising the user, said device comprising a frame including four pivotably interconnected parts comprising:

lower, upper, front and rear frame parts, said lower frame part being mounted between said front frame part and said rear frame part by first and second joint means, respectively;

a stand supporting said lower and front frame parts at a rotation bearing and third joint means, respectively;

a saddle on which the user sits, carried on said upper frame part;

pedals attached to said lower frame part for receiving the feet of the user;

a drive wheel for driving a flywheel, said drive wheel being rotationally mounted to said lower frame part;

a crankshaft which is immovably connected to said drive wheel at a crankshaft bearing; and a connecting rod connected to said crankshaft at a crankshaft connecting rod bearing and connected to said stand at a stationary bearing, so as to determine movements of the parts of the device relative to the stand, the shortest distances between each of;

(1) the crankshaft bearing and a line joining the rotation bearing and the first joint and, (2) the stationary bearing and a horizontal line drawn through the rotation bearing, taken in a vertical direction, all being substantially equal to each other, whereby as the exercising device moves through its cycles of movement, an enhanced harmony of movements is achieved by the parts, relative to the stand, during the cyclic phases of the device.

2. An exercise device according to claim 1, wherein the lower frame part comprises two parallel attached support struts, and the crankshaft is immovably connected to the drive wheel, which is rotatably mounted between said struts.

3. An exercise device according to claim 1, including a casing enclosing all rotatable parts and the connecting rod.

4. An exercise device according to claim 1, wherein the lower frame part carries the crankshaft forward of the rotation bearing.

* * * * *